US005829645A

United States Patent [19]

Hennemann

[11] Patent Number: 5,829,645

[45] Date of Patent: Nov. 3, 1998

[54] PERMEABLE-WALL LIQUID DISPENSING BOTTLE

[75] Inventor: Pascal Hennemann, Eu, France

[73] Assignee: Sofab, Le Treport, France

[21] Appl. No.: 733,779

[22] Filed: Oct. 18, 1996

[30] Foreign Application Priority Data

Oct. 30, 1995 [FR] France ..... 95 12781

[51] Int. Cl.[6] ..... B67D 5/58

[52] U.S. Cl. ..... 222/189.09; 210/198.1; 210/472; 210/496; 210/501; 222/189.11; 222/321.1; 222/321.9

[58] Field of Search ..... 222/189.06, 189.09, 222/321.7, 321.9, 321.1, 321.6, 383.1, 385, 189.11; 210/97, 198.1, 199, 472, 496, 497.01, 501, 510.1

[56] References Cited

U.S. PATENT DOCUMENTS

| | | | |
|---|---|---|---|
| 3,149,758 | 9/1964 | Bush et al. | 222/189.09 |
| 4,533,068 | 8/1985 | Meierhoefer | 222/189.09 |
| 4,615,465 | 10/1986 | Grothoff | 222/321.9 X |
| 4,917,271 | 4/1990 | Kanner et al. | 222/189.09 |
| 5,154,325 | 10/1992 | Ryder et al. | 222/189.09 X |
| 5,183,184 | 2/1993 | Ranalletta et al. | 222/189.09 X |
| 5,209,377 | 5/1993 | Steiner et al. | 222/189.09 |

*Primary Examiner*—Kevin P. Shaver

*Attorney, Agent, or Firm*—Pollock, Vande Sande & Priddy

[57] ABSTRACT

A bottle for dispensing a liquid particularly intended for cosmetic, dermatological, or pharmaceutical applications, or any perfume product. An opening of the bottle is connected to a dispensing head provided with an airless pump, with a valve and with a cap. All or some of the walls of the bottle are made of a plastic having a very high air permeability so as to allow air to pass through the walls of the bottle.

11 Claims, 1 Drawing Sheet

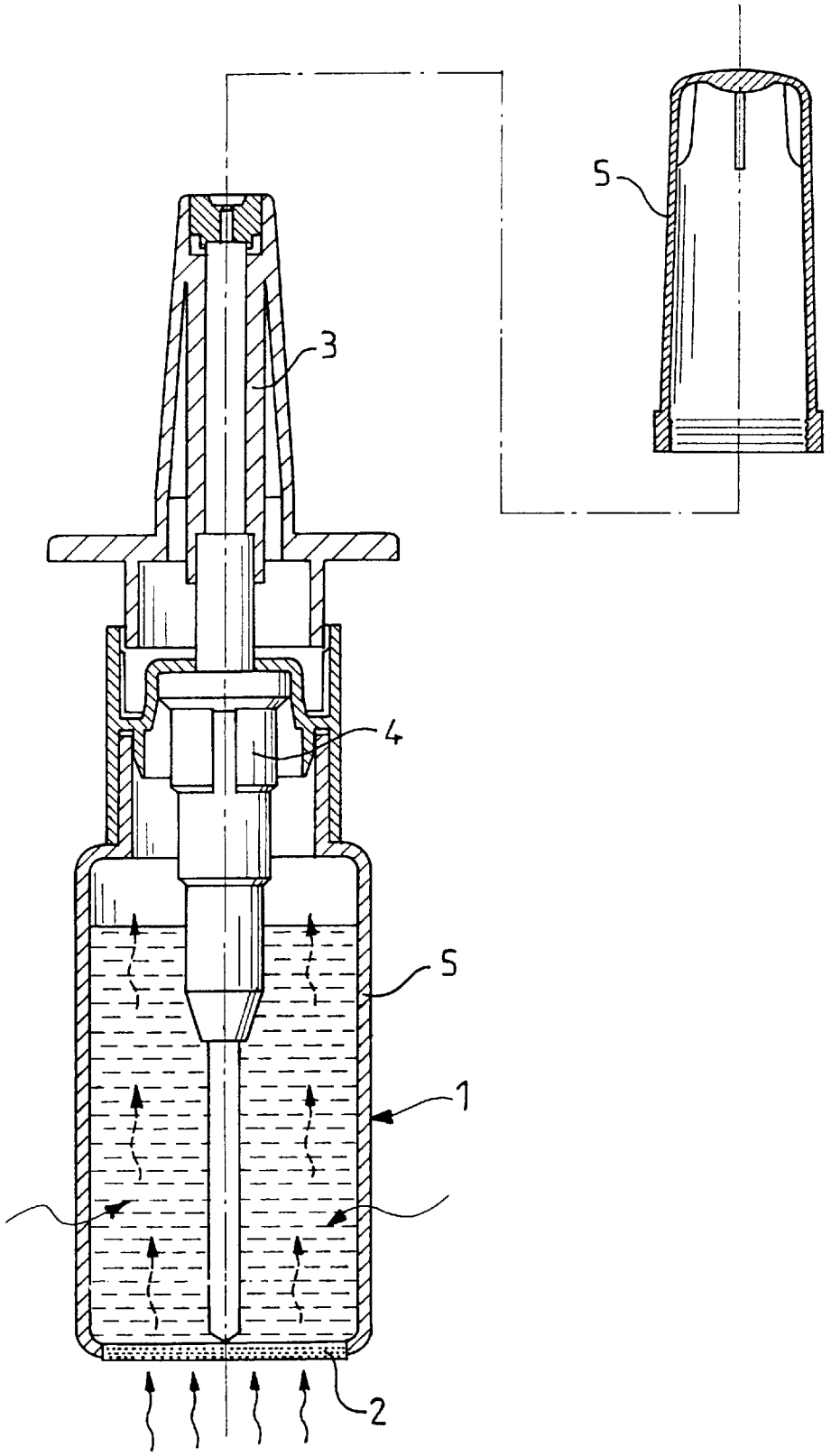
5
3
4
5
1
2

PERMEABLE-WALL LIQUID DISPENSING BOTTLE

FIELD OF THE INVENTION

The resent invention relates to a device for dispensing a product, packaged in liquid form, particularly intended for cosmetic, dermatological, pharmaceutical or ophthalmic applications and any perfumery product. It relates more particularly to a dispensing bottle or container for a liquid product, provided with an end valve closure member and/or with a pump fitted with an end-fitting, the surfaces of which in contact with the active principle have been designed so as to allow air to pass through the walls of the bottle by diffusion.

BACKGROUND OF THE INVENTION

In a known manner, dispensing bottles consist of a rigid or flexible container, containing the product to be dispensed, and a dispensing head which forms a valve or pump. The walls of these bottles are made in a material which is impermeable to the surrounding medium, generally air and water, so as, on the one hand, to prevent impairment of the product contained by air and, on the other hand, to prevent diffusion of the product through the walls. It is therefore necessary to provide a vent on these bottles, this generally being placed on the pump body or on the valve head, in order to compensate for the volume of liquid which has been expelled to the outside.

The main drawback of the dispensing bottles known in the prior art resides mainly in the fact that their venting is via mechanical means. This means that there is:

a reduction in the sterility of the product, hence the necessary presence of antibacterial preservatives;

a risk of the product oxidizing, hence the presence of antioxidants;

a venting function which complicates the construction of the dispensing head.

BRIEF DESCRIPTION OF THE INVENTION

The object of the present invention is therefore to mitigate these drawbacks by proposing a dispensing bottle provided with a head equipped with a valve or with an airless pump (i.e. no intake of air), the mechanisms of which have no venting device, venting taking place by diffusion through one wall of the bottle.

The invention is directed to a bottle for dispensing a liquid particularly intended for cosmetic, dermatological, or pharmaceutical applications, or any perfume product. An opening of the bottle is connected to a dispensing head provided with an airless pump, with a valve and with a cap. All or some of the walls of the bottle are made of a plastic having a very high air permeability so as to allow air to pass through the walls of the bottle.

Other characteristics and advantages of the present invention will emerge from the description given hereinbelow, with reference to the appended single drawing which illustrates an embodiment thereof which is without any limiting character. In the single FIGURE:

BRIEF DESCRIPTION OF THE FIGURE

The single FIGURE is a cross-sectional view, in side elevation, of the bottle forming the subject of the invention.

DETAILED DESCRIPTION OF THE INVENTION

According to a preferred embodiment of the bottle forming the subject of the invention, it includes a container 1 which contains, in liquid form, the solution to be dispensed. This preferably rigid or flexible vessel comprises, at one of its ends, a dispensing system 3 which may be an end valve or an airless pump 4 with a cap 5, the body of the airless pump being immersed in the liquid.

According to one advantageous characteristic of the invention, all or some of the walls of the vessel, in particular the side walls 5, are made in a plastic, especially injection-moldable thermoplastic polymers such as polyolefins, PVC and high-performance polymers, which exhibit high air permeability so as to allow air to pass through the walls of the vessel.

According to a preferred embodiment, a bottle according to the invention is obtained:

either by molding, using a process for the injection blow-molding of a plastic-type material, such as those described above, to which a filler is added, this filler possibly being a substance which makes it possible to increase the diffusion of air, especially chalk;

or by a dual-injection molding process, one of the parts of the bottle, especially the body, being molded from a plastic, such as that described above, the bottom 2 of which being obtained by molding in a substance possessing properties of very high air permeability such as, for example, a silicone elastomer.

The three-dimensional network of the chosen macromolecules allows diffusion of air but prevents the passage of agents which could contaminate the product contained in the container, especially bacteria.

Whatever the manufacturing process, the bottom and the body are assembled by known means (snap fastening or ultrasonic or vibration welding) so as to give shape to a container which allows diffusion of air through one of the walls, especially the wall forming the bottom.

The container which forms the subject of the invention is surmounted by a dispensing head fitted with a valve or with a pump, which enables the liquid contained in the bottle to be dispensed. As a result of the selection of its constituent materials, the bottle acquires rigidity and therefore preserves both its shape and volume after dispensing the product. Expulsion of the product causes a partial vacuum in the volume of the container, which promotes diffusion, through the permeable wall, of a volume of air corresponding to the volume of liquid missing.

According to one advantageous characteristic of the invention, the capture of oxygen molecules through the three-dimensional network of macromolecules is improved by addition of oxygen absorbers to this network.

By virtue of the properties of the walls, the uptake of air occurs in a sterile manner, with no risk of bacterial contamination and with no uptake of oxygen during use.

According to another advantageous characteristic of the invention, those areas of all or some of the various components of the dispensing head 3, fitted with an airless pump 4 or with a valve, which are in contact with the product to be dispensed are treated so as to fix onto those areas a non-migrating antioxidant and/or antiseptic contact agent, that is to say one remaining fixed to the polymer.

Thus, according to a first method, a metal, especially one selected from silver, copper, zinc or mercury, is deposited by electrodeposition on the various metal or plastic componenets.

According to a second method, the antibacterial treatment is performed using a process for grafting an organometallic compound (especially one selected from a silver, copper, zinc, mercury or lead salt) or organic compound to a hydrocarbon, preferably macromolecular, support, especially a polymer.

The grafting process causes a chemical reaction between the product to be grafted and the support, so that they are chemically bonded to each other. The product, in our case the antibacterial agent, is attached in a stable manner to the support and cannot migrate, or be detached from the support, into the solution which is dispensed via the said device which forms the subject of the invention.

The grafting is carried out especially using ionizing radiation, of the alpha, beta or gamma type. The antibacterial agent to be grafted and the surfaces of the support are in contact with each other and, due to the effect of the energy of the ionizing radiation, produce stable chemical bonds.

It is important that both the surfaces of the various components to be grafted and the molecules of the product of the antibacterial agent each have chemical structures comprising tertiary carbon atoms, unsaturated carbon atoms or any chemical group which can be ionized by the ionizing radiation, thus forming free radicals which interact.

For both processes described above, the supports of the grafted components are then washed in order to remove the excess of antibacterial agent not chemically fixed to the said surfaces.

According to a third method, the various components made of plastic are molded in the presence of an insoluble antibacterial agent, especially silver incorporated into the plastic at the time of molding.

In this case, molding polyethylene in the presence of 1% by weight silver-based antibacterial agent produces effective protection against the contaminating medium (a population of 50,000 *Escherichia Coli* organisms is reduced in 6 hours to less than 10 organisms).

The bottles which form the subject of the invention have, depending on the plastics selected for making them, either flexible permeable walls or rigid permeable walls, or configurations with a valve or a pump, respectively.

All or some of the elements forming the airless pump, the valve and the end-fitting are treated with a means of providing antibacterial contact protection.

The present invention offers many advantages since it makes it possible to reduce the toxicity of the product contained in the container as a result of the absence of antibacterial and/or antioxygen preserving agents, the bottle according to the invention therefore being used in a sterile manner.

It remains the case that, of course, the present invention is not limited to the embodiments described and shown hereinabove, but that it encompasses all variants thereof.

I claim:

1. A liquid dispensing container comprising:

a bottom wall;

a side wall having an opening at an end thereof;

a dispensing head connected to the opening end, the head including a) an airless pump;

b) a valve connected upstream of the pump; and c) a cap for selectively sealing a dispensing end of the pump;

at least one selected wall of the container being made of a high permeability plastic material for allowing air to pass into the container.

2. A container according to claim 1, wherein the side wall is made of an air permeable injection molded thermoplastic polymer.

3. A container according to claim 1, wherein the bottom wall is made of an air permeable material.

4. A container according to claim 1 wherein at least one of the walls incorporates a filler that increases the diffusion of air.

5. A container according to claim 1 wherein at least one of the walls includes an oxygen-absorbing agent.

6. A container according to claim 1 wherein preselected surface areas of the dispensing head, that contact the liquid, are treated with an antioxidant contact agent which does not migrate into the liquid.

7. A container according to claim 1 wherein preselected surface areas of the dispensing head, that contact the liquid, are treated with an antiseptic contact agent which does not migrate into the liquid.

8. A container according to claim 1 wherein preselected surface areas of the dispensing head, that contact the liquid, are treated with antiseptic and antioxidant contact agents which do not migrate into the liquid.

9. A container according to claim 2 wherein the side wall is made of an injection moldable thermoplastic polymers selected from the group consisting of polyolefins, PVC or high performance polymers.

10. A container according to claim 1 wherein the bottom wall is made of a silicone elastomer.

11. A container according to claim 4 wherein the filler is chalk.

* * * * *